US005479886A

United States Patent [19]

Leonard et al.

[11] Patent Number: 5,479,886

[45] Date of Patent: Jan. 2, 1996

[54] ENGINE OIL CAPACITOR

[75] Inventors: Jay F. Leonard; Richard J. Gustafson, both of Columbus, Ind.; Mark B. Hinderleider, Jamestown, N.Y.

[73] Assignee: Cummins Engine, Columbus, Ind.

[21] Appl. No.: 440,060

[22] Filed: May 12, 1995

[51] Int. Cl.[6] ..... F01M 1/00

[52] U.S. Cl. ..... 123/196 R; 123/90.33; 184/6.2

[58] Field of Search ..... 123/90.33, 90.34, 123/90.38, 196 R, 195 C; 184/6.2, 6.5

[56] References Cited

U.S. PATENT DOCUMENTS

| | | | |
|---|---|---|---|
| 1,100,023 | 6/1914 | Link . | |
| 1,390,393 | 9/1921 | Spence . | |
| 1,423,677 | 7/1922 | Nicholls . | |
| 2,280,753 | 4/1942 | Essl . | |
| 4,206,739 | 6/1980 | Schrag | 123/196 R |
| 4,270,497 | 6/1981 | Valerio | 123/195 C |
| 4,519,348 | 5/1985 | Hamilton | 123/195 C |
| 4,991,549 | 2/1991 | Sugiura | 123/90.34 |
| 5,092,291 | 3/1992 | Langlois | 123/196 R |

*Primary Examiner*—Noah Kamen

*Attorney, Agent, or Firm*—Woodard, Emhardt, Naughton Moriarty & McNett

[57] ABSTRACT

An engine oil capacitor which allows a larger volume of oil to be used in an internal combustion engine without reducing fuel economy or increasing engine package size. Oil flow through the normal oil drainback holes is partially restricted, resulting in a substantial quantity of oil being temporarily stored in an engine compartment, such as the camshaft compartment, during engine operation.

22 Claims, 16 Drawing Sheets

ENGINE OIL CAPACITOR

TECHNICAL FIELD OF THE INVENTION

The present invention relates generally to internal combustion engines, and more particularly to an engine oil capacitor which allows for a higher ratio of oil volume to engine volume.

BACKGROUND OF THE INVENTION

In an internal combustion engine, a supply of engine lubricant, such as petroleum oil, is provided in an oil pan at the bottom of the engine. During operation of the engine, a pump is used to carry the oil from the pan up into the working portions of the engine in order to lubricate the engine's moving parts. As oil is continuously supplied to these moving parts, excess oil drains back to the oil pan through various paths by the operation of gravity. In this way, oil is continuously circulated through the engine while it is operating.

Referring to FIG. 1, there is illustrated a camshaft compartment of a prior art internal combustion engine, the camshaft compartment being indicated generally at 10. The compartment 10 includes end walls 12 and 24, as well as dividing walls 14–22. Each of the walls 12–24 include a respective cam journal 26 formed therethrough. A camshaft 28 (shown in phantom in FIG. 2) is rotatably supported by the cam journals 26.

Oil is supplied by the engine oil pump to the camshaft 28 in order to lubricate the camshaft 28 as it rotates in the cam journals 26. During this process oil is continuously drained off of the camshaft 28 into the bottom of the compartment, 10. This excess oil must be drained back into the oil pan so that it may once again be pumped into the lubrication circuit. The compartment 10 includes a plurality of large drainback holes 30 which allow the excess oil to drain back to the oil pan. As best illustrated in FIG. 2, the walls 14, 18 and 22 do not extend all the way to the bottom of the compartment 10, thereby forming three separate chambers 19, 21 and 23, each chamber having two drainback holes 30. Because the drainback holes 30 are large enough to allow a significant quantity of oil to pass therethrough, no appreciable quantity of oil remains in the compartment 10 during engine operation. All excess oil is immediately returned to the oil pan.

Consumers who purchase internal combustion engines desire engines which contain a large volume of oil. The larger the oil volume, the longer the drain interval between required oil changes, and therefore the engine exhibits lower maintenance costs. The longer drain interval results from a lower duty cycle for each particular oil molecule when the total quantity of oil molecules is increased. However, if the oil pan is simply tilled with more oil, the fuel economy of the engine is lowered. This results from the fact that the oil pan is situated immediately below the engine crankshaft. As the level of oil in the pan is increased, the rotating crankshaft interacts with the oil, causing drag on the crankshaft and windage losses which lower the efficiency of the engine. It is not feasible to provide a larger oil volume by simply increasing the size of the oil pan. This is because consumers also desire a small engine package size.

In the past, therefore, engine designers have been forced to make trade-offs between oil volume, fuel economy and package size. Such trade-offs have been thought to be necessary when more oil is required, but more oil can't be added to the pan and the pan can't, be made larger. There is therebefore a need in the prior art for a way to increase engine oil volume without lowering engine fuel economy or increasing engine package size. The present invention is directed toward meeting this need.

SUMMARY OF THE INVENTION

The present invention relates to an engine oil capacitor which allows a larger volume of oil to be used in an internal combustion engine without reducing the economy or increasing engine package size. Oil flow through the normal oil drainback holes is partially restricted, resulting in a substantial quantity of oil being temporarily stored in an engine compartment, such as the camshaft compartment, during engine operation.

In one form of the invention, an engine compartment having an oil capacitor function is disclosed, the engine compartment comprising at least one primary oil drainback hole formed in the engine compartment and operative to channel oil flowing therethrough to an oil pan, wherein the primary oil drainback hole is positioned such that the oil must accumulate to a first level before the oil can flow through the primary oil drainback hole; and at least one secondary oil drainback hole formed in the engine compartment and operative to channel oil flowing therethrough into the oil pan, wherein the secondary oil drainback hole is positioned such that the oil must be at a second level before the oil can flow through the secondary oil drainback hole; wherein the first level is higher than the second level such that a quantity of oil is stored in the engine compartment when the oil is at the first level: and wherein a first flow capacity of the primary oil drainback hole is greater than a second flow capacity of the secondary oil drainback hole; and wherein the oil is supplied to the engine compartment at a flow rate which is less than the first flow capacity and greater than the second flow capacity.

In another form of the invention, an oil capacitor insert adapted to be placed within an engine compartment is disclosed, the insert comprising a plurality of walls forming an oil retention cavity; a weir formed in at least one of the walls and operative to drain oil from within the oil retention cavity, wherein the weir is positioned such that the oil must accumulate to a first level before the oil can flow over the weir; and a drainback hole formed in at least one of the walls and operative to drain oil from within the oil retention cavity, wherein the drainback hole is positioned such that the oil must be at a second level before the oil can flow through the drainback hole; wherein the first level is higher than the second level such that a first quantity of oil is stored in the oil retention cavity when the oil is at the first level; and wherein a first flow capacity of the weir is greater than a second flow capacity of the drainback hole; and wherein the oil is supplied to the insert at a flow rate which is less than the first flow capacity and greater than the second flow capacity.

In another form of the invention, an internal combustion engine including at least one oil capacitor insert adapted to engage an oil drainback hole formed in a wall of an engine compartment of said engine is disclosed, each insert comprising a body member having an opening therein; at least one retention member coupled to the body member, wherein the retention member is operative to engage the wall such that the drainback hole is filled in by the body member; a stack coupled to the body member opening, the stack having a stack opening at a top surface thereof and a hollow interior channel coupling the stack opining to the body member opening for fluid flow therebetween; wherein the stack opening is at a level above a bottom of the drainback hole, such that oil supplied to the engine compartment accumulates therein until the oil reaches the level of the stack opening and flows through the interior channel and through the drainback hole.

DESCRIPTION OF THE PREFERRED EMBODIMENT

Figure 1:
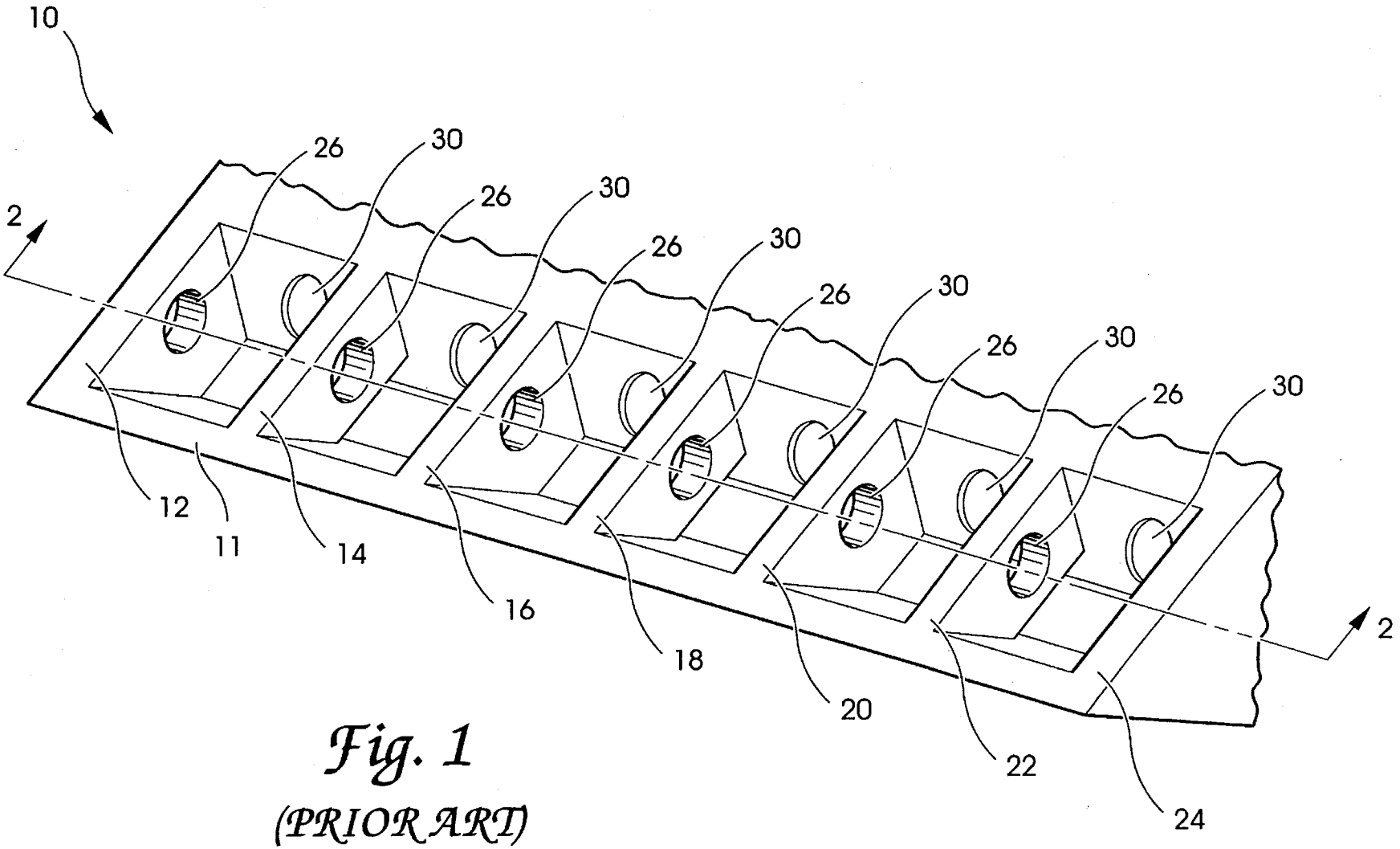
Fig. 1 (PRIOR ART)
FIG. 1 is a perspective view of a prior art camshaft compartment.
Figure 2:
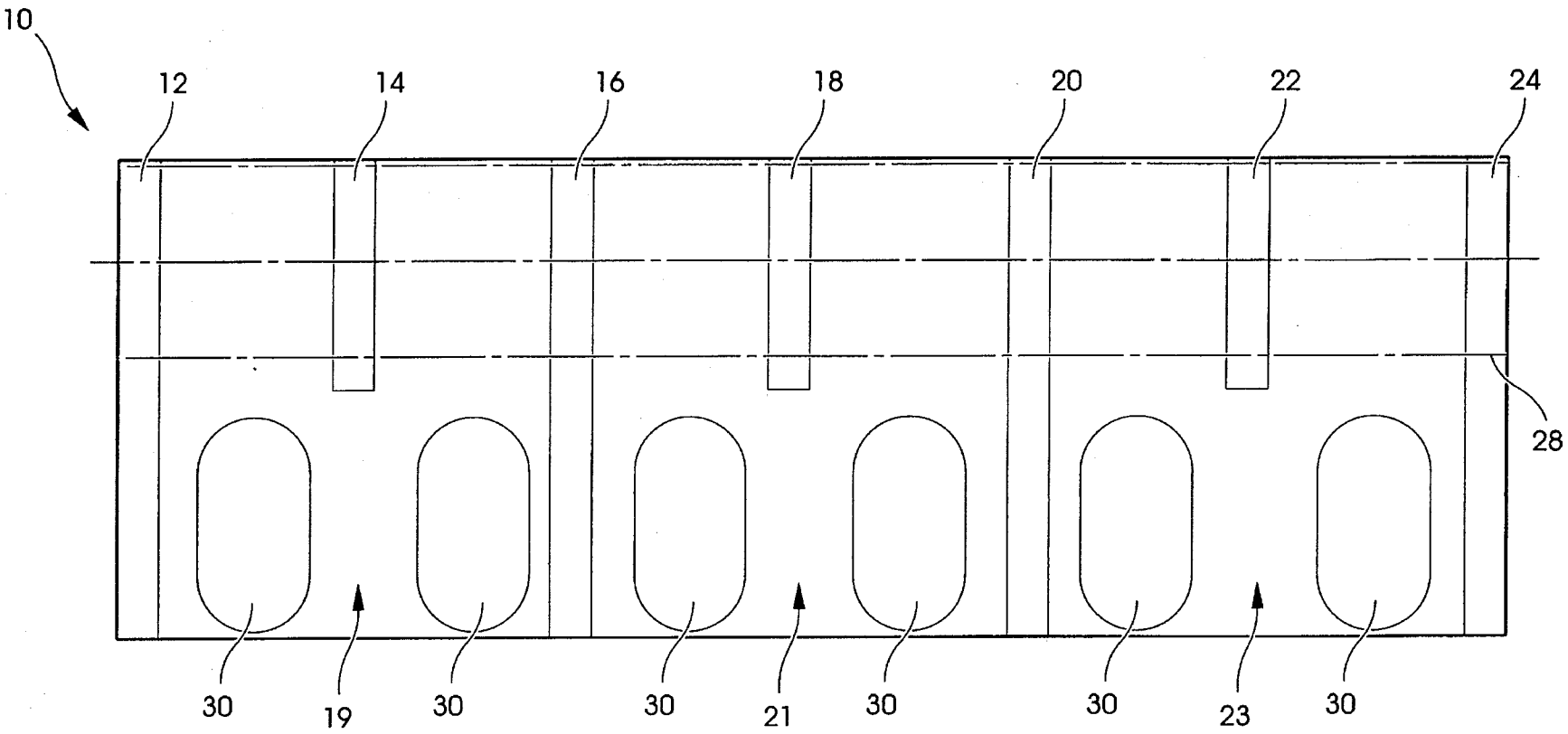
Fig. 2 (PRIOR ART)
FIG. 2 is a cross-sectional view of the prior art camshaft compartment of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention allows for an increased quantity of oil to be used in an engine without increasing engine package size or reducing fuel economy. The present invention accomplishes this by changing the design of an upper engine compartment, such as the camshaft compartment, so that a significant quantity of oil is held in the camshaft compartment during engine operation. When the engine is started and oil is circulated by the oil pump, the camshaft compartment is filled with oil. When the oil in the camshaft compartment reaches a desired steady state level, and excess oil is drained back to the oil pan. The present invention is therefore analogous to the charging of a capacitor in an electronic circuit. In one embodiment, a quantity of oil is retained in the camshaft compartment after engine shut down in order to prelubricate the camshaft at the next engine start.

Figure 3:
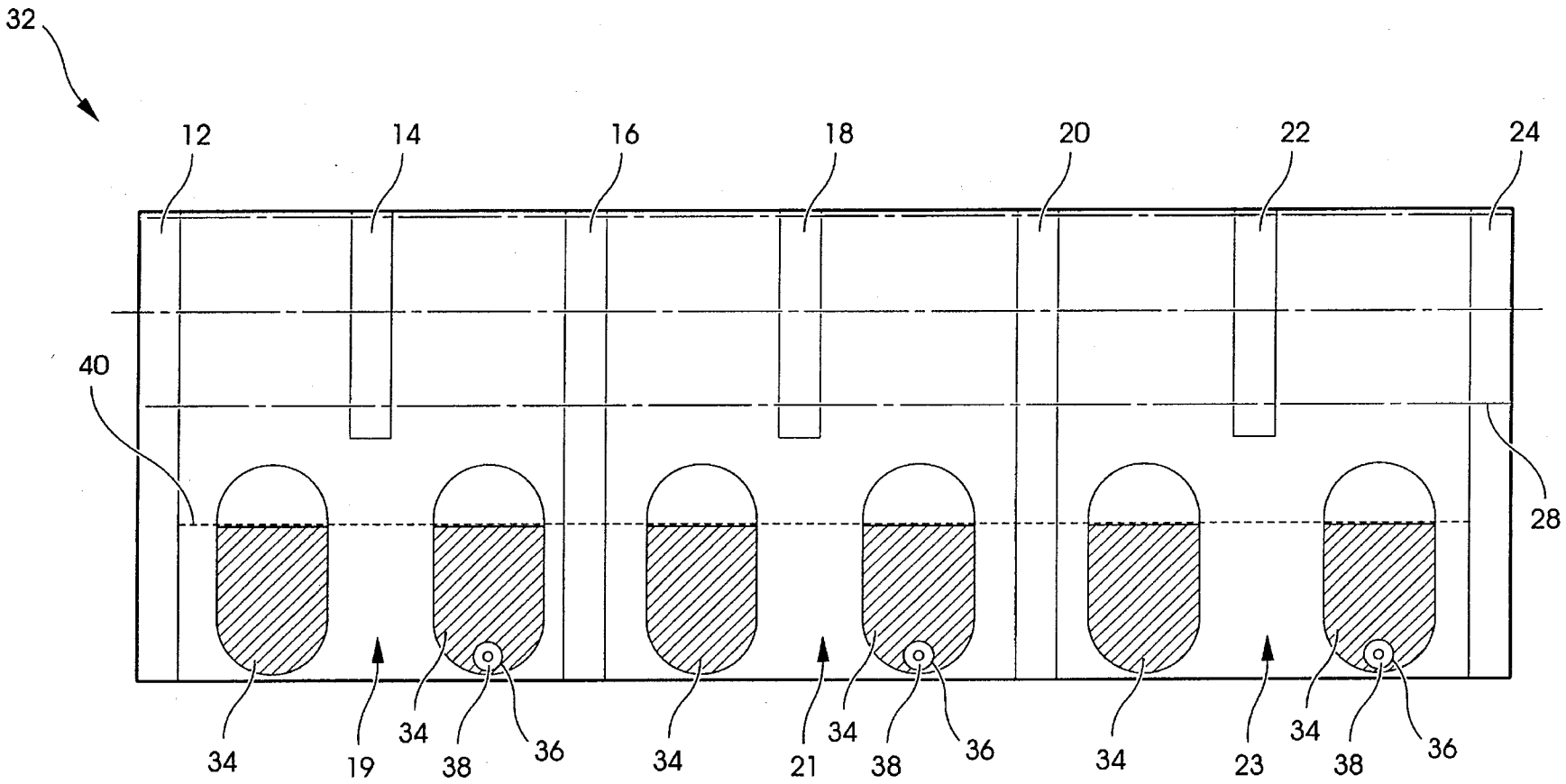
FIG. 3 is a cross-sectional view of a first embodiment of the present invention.

Referring to FIG. 3, there is illustrated a cross-sectional view of the first embodiment of the present invention, indicated generally at 32. The camshaft compartment 32 is identical to the camshaft compartment 10 of the prior art, with the exception that the block casting has been altered in order to partially restrict the oil drainback holes 30 in the areas marked 34. The restricted areas 34 cover the lower portions of the drainback holes 30, the upper portions thereof remaining open. Additionally, a hole 36 is formed in alternating ones of the restricted areas 34, in order to provide a small orifice for drainage of the stored oil back to the oil pan. Preferably, a grommet 38 is positioned in each of the holes 36 in order to more accurately size these oil drain orifices.

When the engine is started, oil is pumped into the camshaft compartment 32 by the oil pump. Because of the relatively small size of the orifices in the grommets 38, oil is pumped into the compartment 32 faster than it can drain therefrom. Therefore, oil quickly accumulates in the compartment 32 until it reaches the level 40 which coincides with the top of the restricted areas 34. If the oil level attempts to rise above the level 40, it overflows the top of the restricted areas 34 in a weir action. Oil so overflowing drains back to the oil pan. While a small amount of oil is continuously draining through the grommets 38 back to the oil pan, the amount of oil entering the compartment 32 is greater than the amount of oil draining through the grommets 38 but less than the amount of oil draining over the restricted areas 34. The level of oil in the compartment 32 is therefore maintained at 40 by the restricted areas 34.

It will be appreciated by those skilled in the art that a significant quantity of oil may thus be stored in the compartment 32 when the engine is operating. This allows for an increase in the amount of oil used in any particular engine, without requiring that this oil be stored in the oil pan while the engine is running. Therefore, once the compartment 32 fills with oil to the level 40, there is no interaction between the engine crankshaft and the excess oil, because the excess oil is not stored in the oil pan. When the engine is shut down, the oil stored in compartment 32 will slowly drain back to the oil pan through the orifices in the grommets 38. By use of the present invention, the amount of oil used in the engine may be significantly increased without increasing the size of the oil pan and without causing increased interaction between the crankshaft and the engine oil in the oil pan.

Figure 4:
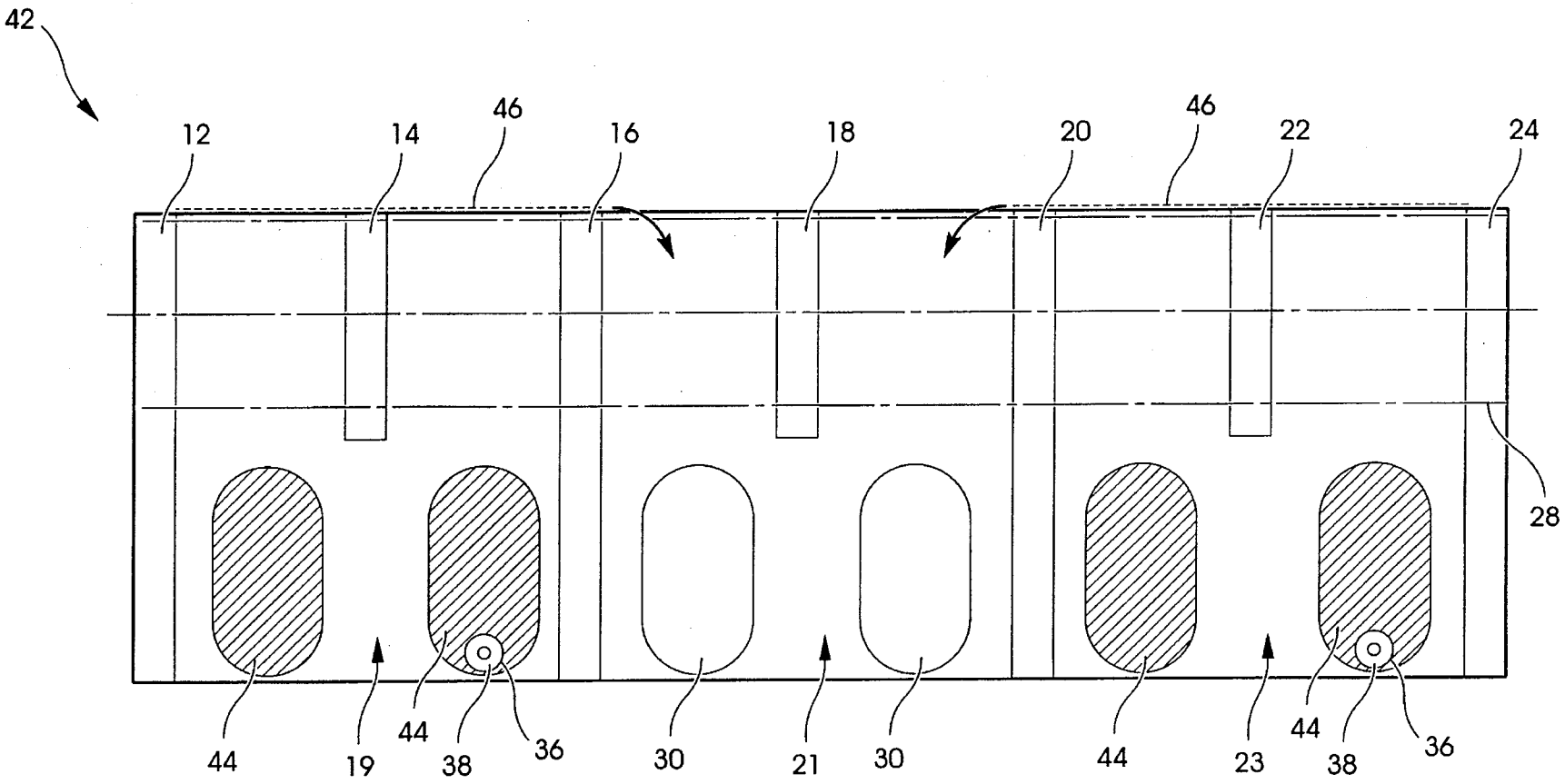
FIG. 4 is a cross-sectional view of a second embodiment of the present invention.

Referring now to FIG. 4, there is illustrated a second embodiment of the present invention, indicated generally at 42. In the camshaft compartment 42, the block casting is altered such that the oil drainback holes 30 and the chambers 19 and 23 are completely restricted by the areas 44. The oil drainback holes 30 in the middle chamber 21 remain completely open. One of the restricted areas 44 in each of the chambers 19 and 23 is provided with a hole 36 containing a grommet 38 having a small oil drain orifice therein. When the engine is operated, oil is pumped into the compartment 42 from the engine oil pan. The oil in the chamber 21 immediately drains back to the oil pan because the oil drainback holes 30 are unrestricted. However, the oil pumped into the compartments 19 and 23 may only drain through the small orifices in the grommets 38. Oil therefore accumulates in the chambers 19 and 23 until it reaches the level 46 which coincides with the top of the compartment 42.

When the oil in the chambers 19 and 23 reaches the level 46, it will spill over the walls 16 and 20 and into the middle chamber 21 in a weir action. The size of the drainback holes 30 in the chamber 21 are sufficient to immediately drain this oil back to the oil pan. Therefore, during engine operation, the camshaft 28 is completely immersed in oil within the chambers 19 and 23. Such immersion provides for noise reductions and a damping of camshaft vibration transmitted to the engine's geartrain.

Figure 5:
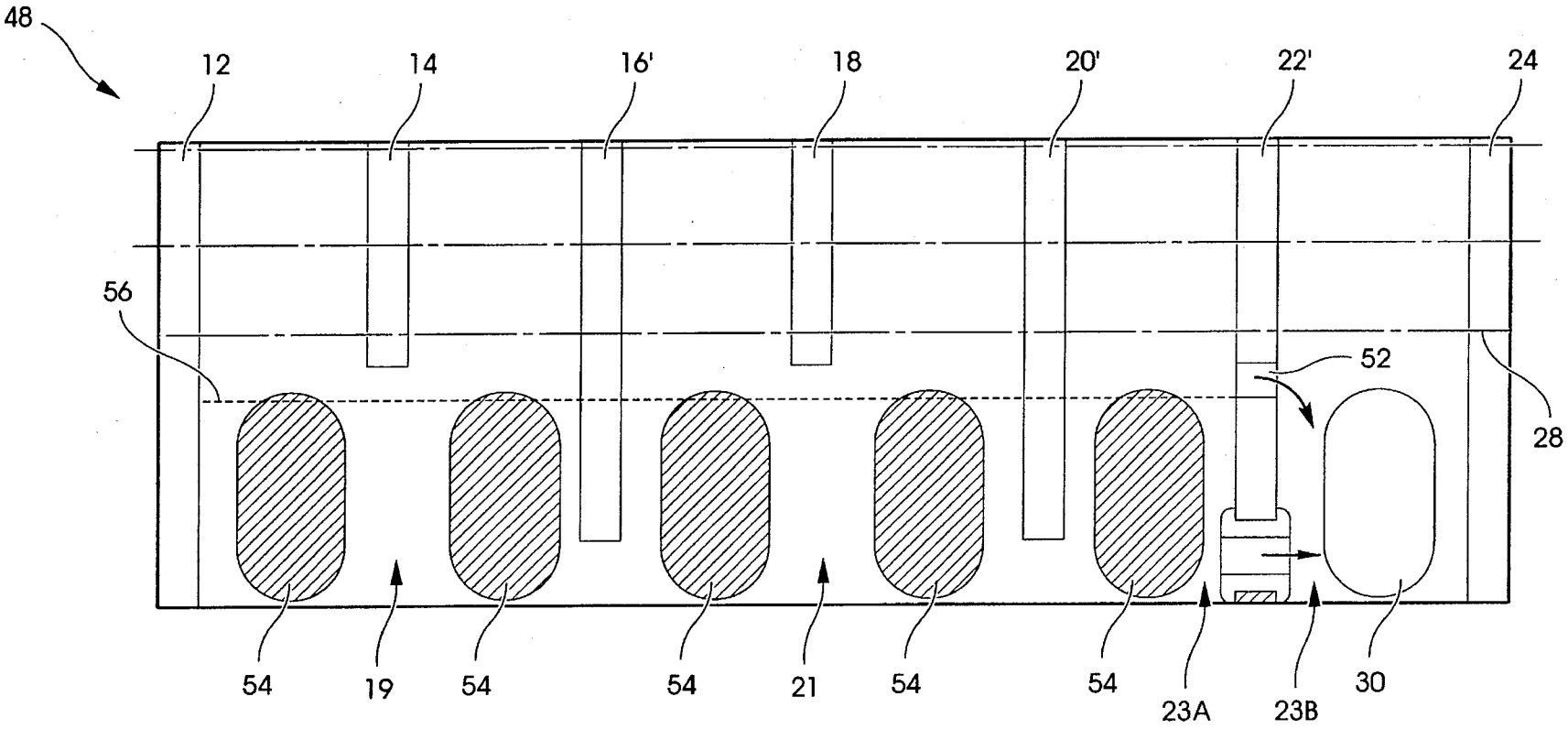
FIG. 5 is a cross-sectional view of a third embodiment of the present invention.
Figure 6:
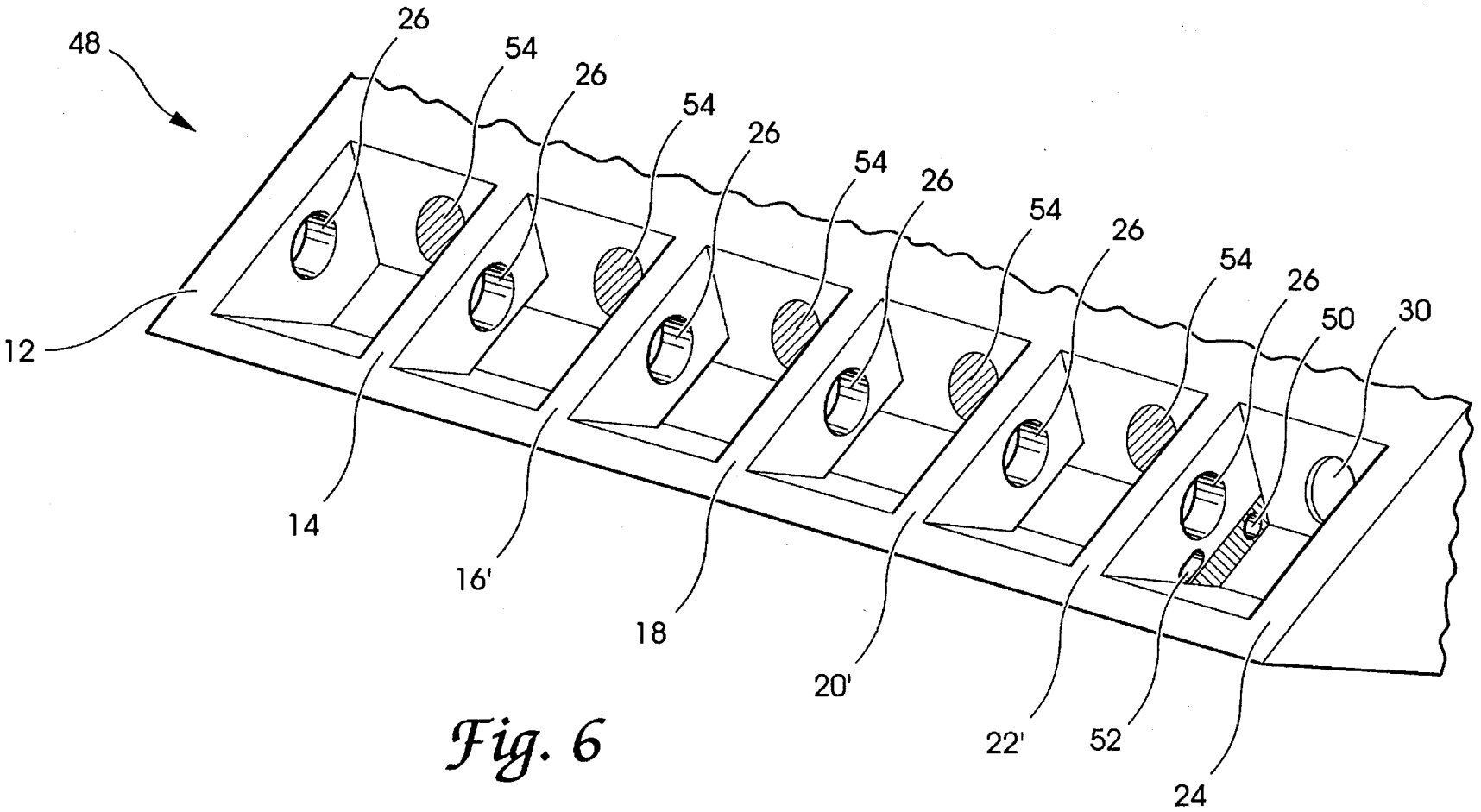
FIG. 6 is a perspective view of the third embodiment of the present invention.

Referring now to FIG. 5, there is illustrated a third embodiment of the present invention, indicated generally at 48. In the camshaft compartment 48, the block casting has been altered by replacing the wall 16 with the wall 16'. The wall 16' does not extend all the way to the bottom of the compartment 48, thereby joining the chambers 19 and 21 together. Similarly, the wall 20 has been replaced with a wall 20' which does not extend all the way to the bottom of the compartment 48. This has the effect of joining the chambers 21 and 23. However, the wall 22 has been replaced with a wall 22' which extends all the way to the bottom of the compartment 48, thereby dividing the chamber 23 into a subchamber 23A and a subchamber 23B. A grommet 50 having a central orifice is formed in the wall 22' in order to provide a path for oil flow between the subchamber 23A and the subchamber 23B. Furthermore, a slot 52 is formed in the wall 22' in order to provide a secondary path for oil flow between the subchamber 23A and the subchamber 23B. The relative positioning of the grommet 50 and the slot 52 is better illustrated in the perspective view of FIG. 6.

The block casting is further altered in that the oil drainback holes 30 in the chamber 19, the chamber 21 and the subchamber 23A have been completely blocked by restricted areas 54. When the engine is started, oil is pumped into the compartment 48 by the oil pump, but cannot drain from chamber 19, chamber 21 or subchamber 23A because of the restrictions 54. Oil therefore accumulates in these areas, which are in fluid communication with one another because of the altered walls 16' and 20', until the oil reaches the level 56. The level 56 corresponds with the bottom of the slot 52. Once oil reaches the level 56, it flows into the subchamber 23B through the slot 52 in a weir action. The slot 52 is sized large enough to drain all of the oil which exceeds the level 56. Such oil flowing into the subchamber 23B is immediately drained through the unrestricted drainback hole 30. By selecting the position of the slot 52, the level 56 can be adjusted to lie at any point within the compartment 48. When the engine is shut down, the orifice in the grommet 50 allows all of the stored oil to drain from the chamber 19, the chamber 21 and the subchamber 23A back to the oil pan.

Figure 7:
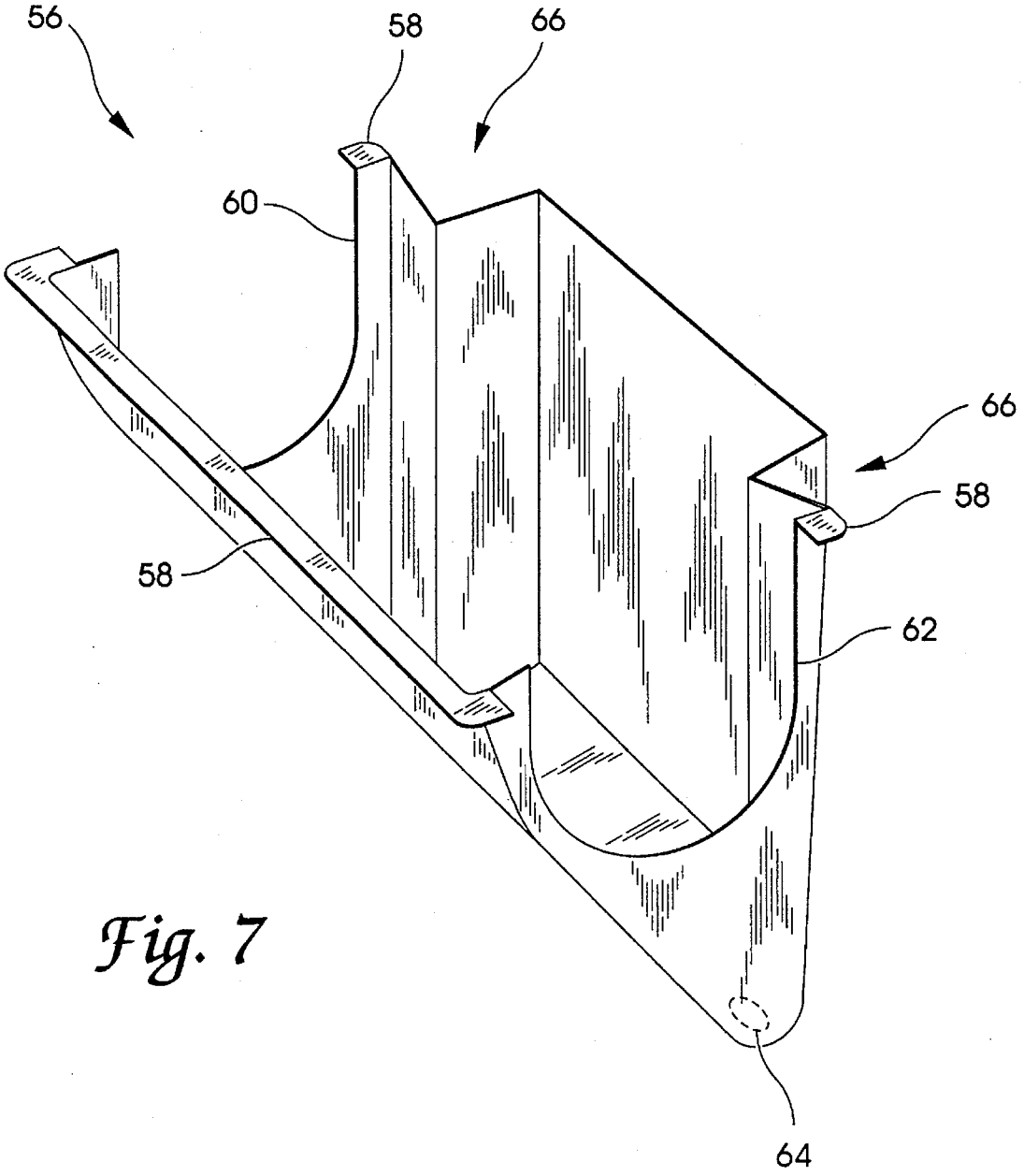
FIG. 7 is a perspective view of a fourth embodiment of the present invention.

Referring now to FIG. 7, there is illustrated a perspective view of a fourth embodiment of the present invention, indicated generally at 56. The oil capacitor insert 56, which is preferably made of plastic or metal, is designed to fit between adjacent walls of the prior art camshaft compartment 10 and forms an oil retention cavity therein. For example, the protruding lip 58 extends over the walls 11, 12 and 14 when the insert 56 is installed in the first subchamber of the camshaft compartment 10 of FIG. 1. The dimensions of the insert 56 are preferably just slightly smaller than the dimensions of the subchamber, so that there is no relative movement between the insert 56 and the camshaft compartment 10 after installation. The insert 56 includes two cutouts 60 and 62 which allow the camshaft 28 to pass through the insert 56 without touching the insert 56.

The insert 56 occupies most of the space within the subchamber and collects the oil which would normally be drained through drainback hole 30. The insert 56 includes a small drainback hole 64 in the bottom thereof, however the rate that oil drains through the hole 64 is much less than the rate that oil is supplied to the subchamber. Therefore, the insert 56 will fill with oil during operation of the engine until the oil spills over the weirs 66. The oil that flows over weirs 66 is drained back to the oil pan by the drainback hole 30. It will be appreciated by those skilled in the art that the insert 56 allows for oil to be stored in each of the subchambers up to the level of the weir 66. It will be further appreciated that this is done without altering the block casting of the engine, thereby making it much easier to implement the insert 56 than to implement any of the block casting modifications illustrated in FIGS. 3–6. Furthermore, the insert 56 stores a greater quantity of oil than the embodiments of FIGS. 3–6, in that the camshaft 28 is completely submerged in oil in each of the subchambers. This will provide noise reductions and damping of camshaft vibrations transmitted to the engine's gear train, and better cam and roller lubrication.

Figure 8:
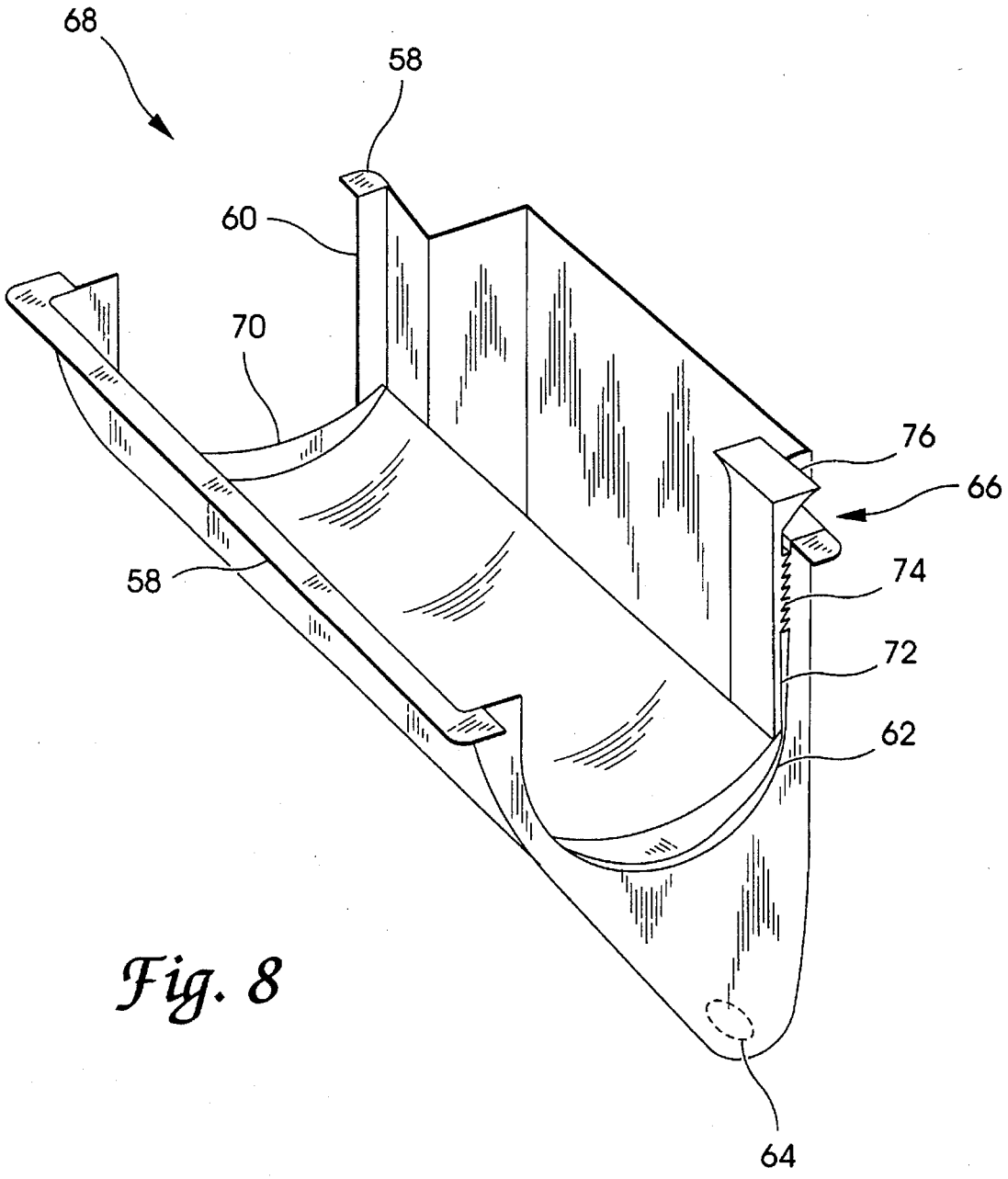
FIG. 8 is a perspective view of a fifth embodiment of the present invention.

Referring now to FIG. 8, there is illustrated a perspective view of a fifth embodiment of the present invention, indicated generally at 68. The insert 68 is substantially similar to the insert 56 of FIG. 7, with the exception that the insert 68 includes a wetting tray 70 formed therein. The wetting tray 70 is hingedly attached to the insert 68 along the edge of the wetting tray 70 which is hidden in the view of FIG. 8. The wetting tray 70 includes an upwardly extending arm 72 which has a series of teeth (not shown) which mate with teeth 74 formed on the insert 68. The engagement of the two sets of teeth keep the wetting tray 70 in the desired position until it is manually moved. It is necessary to move the wetting tray 70), for example, during installation or removal of the camshaft 28. During this operation, the wetting tray 70 may be lowered by simply pushing on the tab 76 on the top of the arm 72, which allows the wetting tray 70 to be pushed downward, pivoting on its hinged edge. In this lowered position, the wetting tray 70 will not interfere with installation or removal or the camshaft 28. Once the camshaft 28 has been installed, the wetting tray 70 may be raised into position by pulling on the tab 76 until the wetting tray 70 has been raised to the desired position.

The insert 68 stores oil in the same way as the insert 56 of FIG. 7, with the exception that the shallow wetting tray 70 will store a small quantity of oil after engine shutdown. This quantity of oil will never drain back to the oil pan. Upon the next engine start, the oil contained in the wetting tray 70 will prelubricate the camshaft 28 prior to the engine oil system becoming pressurized. This prelubrication of the camshaft 28 will significantly reduce wear on the camshaft.

Figure 9:
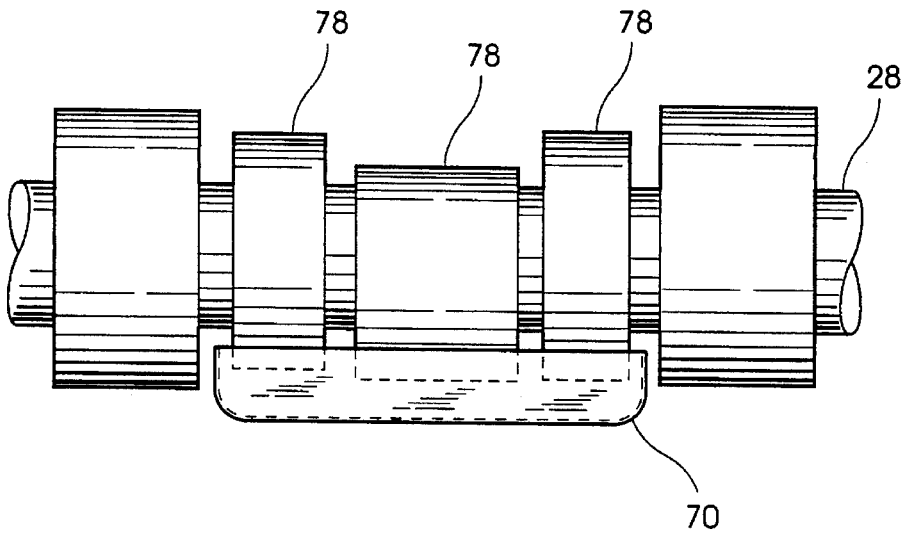
FIG. 9 is a side elevational view of a portion of the fifth embodiment of the present invention.
Figure 10:
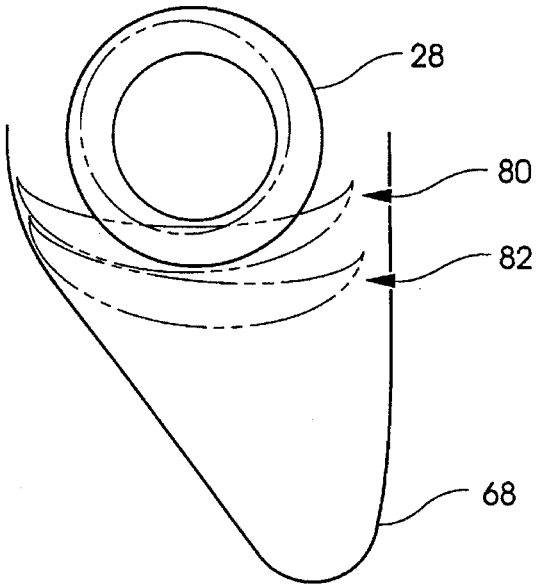
FIG. 10 is a cross-sectional view of the fifth embodiment of the present invention.

Referring to FIG. 9, the interaction between the wetting tray 70 and the camshaft 28 is illustrated. It can clearly be seen that the lobes 78 of the camshaft 28 are immersed in the oil trapped in the wetting tray 70 during rotation of the camshaft 28. Referring to FIG. 10, the insert 68, wetting tray 70 and camshaft 28 are illustrated in a side view. The wetting tray 70 is illustrated in its free running state at 80, while the wetting tray 70 is illustrated in its installation/removal state at 82. It can be seen that the wetting tray 70 does not interfere with installation or removal of camshaft 28 when it is in the position 82, and that the wetting tray 70 provides prelubrication of the camshaft 28 when it is in position 80.

Figure 11:
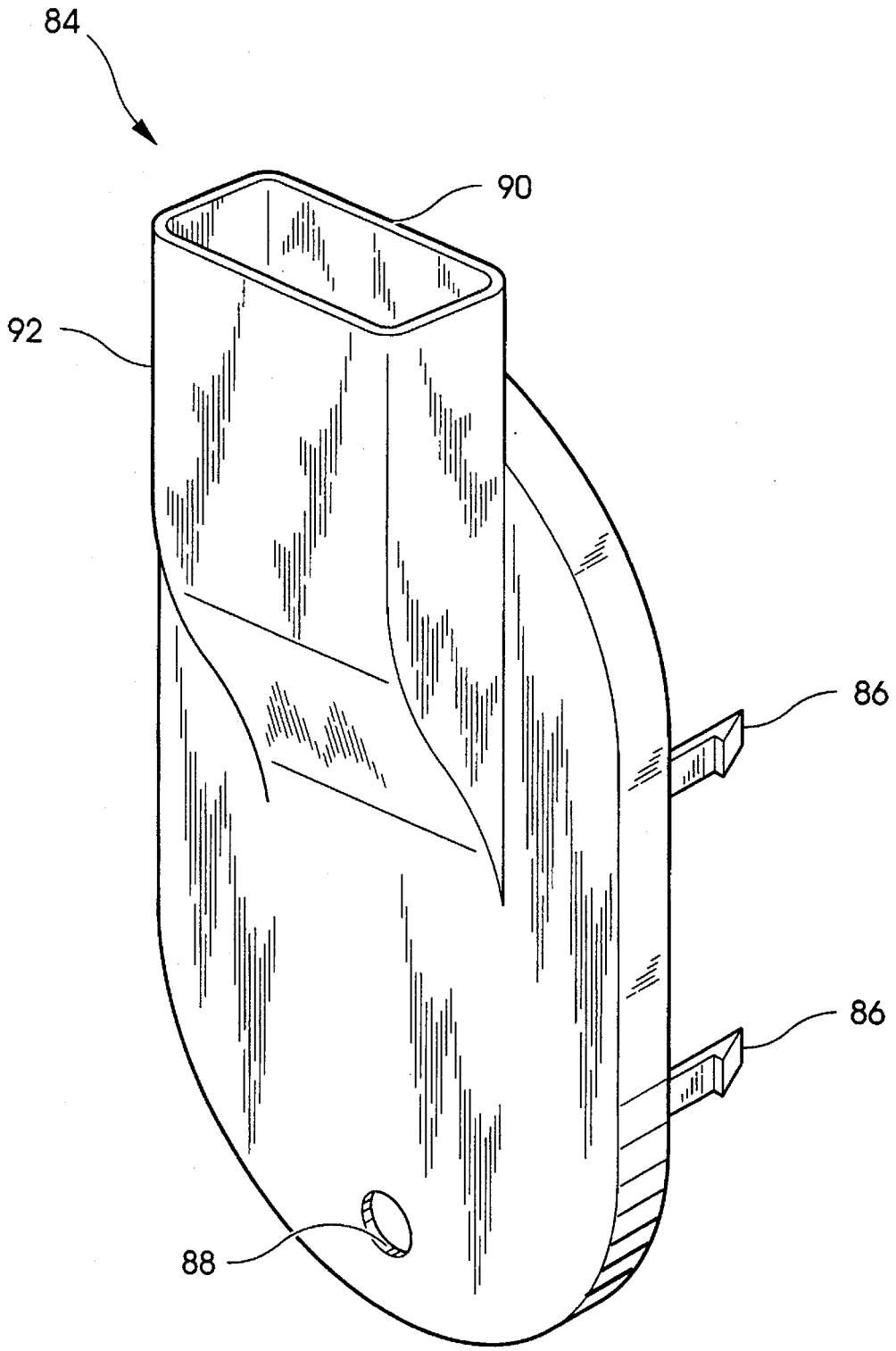
FIG. 11 is a front perspective view of a sixth embodiment of the present invention.

A sixth embodiment of the present invention is illustrated in FIG. 11, and indicated generally at 84. Like the fifth embodiment of the present invention, the insert 84 allows for oil storage in the camshaft compartment without alteration of the existing block casting. The insert 84 mounts to the drainback holes 30 of the prior art camshaft compartment 10, by means of the integral tangs 86. The insert 84 mounts to the drainback holes 30 from inside the camshaft compartment 10, with the tangs 86 extending through the drainback holes 30 and gripping the opposite side of the wall in which the drainback holes 30 are throned. When the insert 84 is installed in the drainback hole 30, substantially all of the drainback hole 30 is obstructed. The insert 84 includes a small drainback hole 88 formed therethrough, but the rate at which oil drains through the hole 88 is much less than the rate at which oil is supplied to the camshaft, compartment 10. Therefore, oil will accumulate in the camshaft compartment 10 until the oil level reaches the top 90 of the spill-over stack 92. At this level, the oil will spill over the edge 90 in a weir action.

Figure 12:
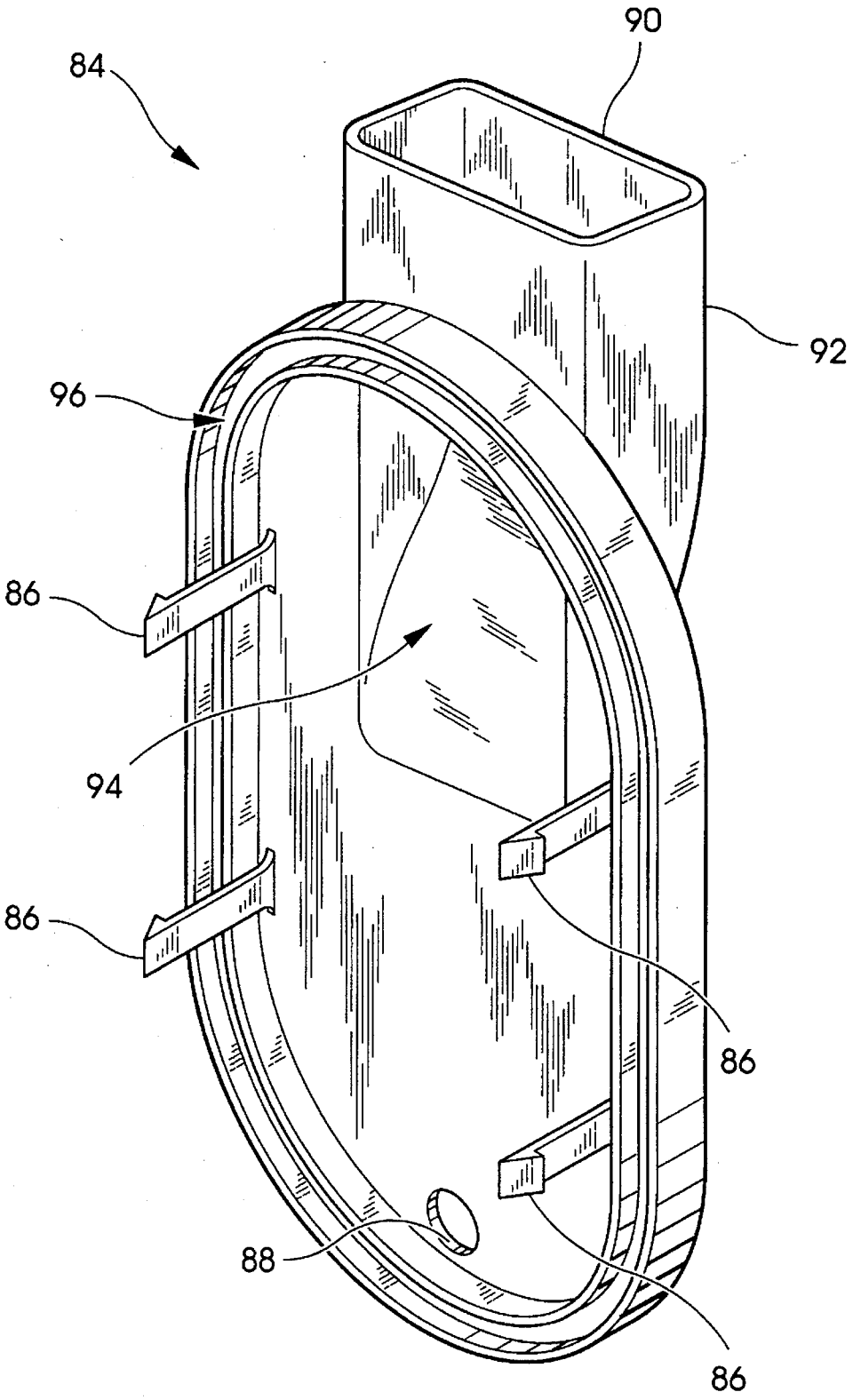
FIG. 12 is a rear perspective view of the sixth embodiment of the present invention.
Figure 13:
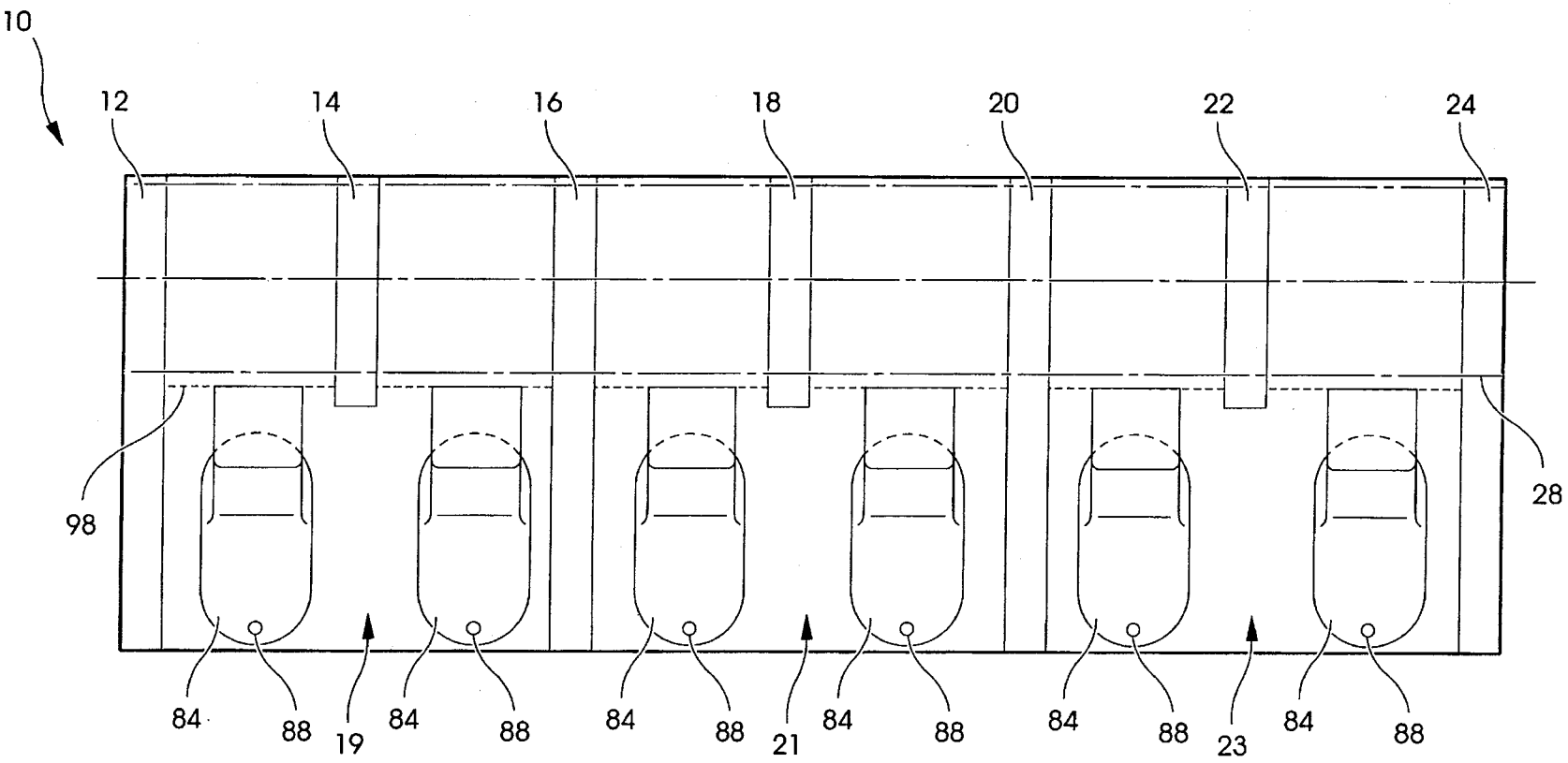
FIG. 13 is a cross-sectional view of a camshaft compartment including the sixth embodiment of the present invention.
Figure 14:
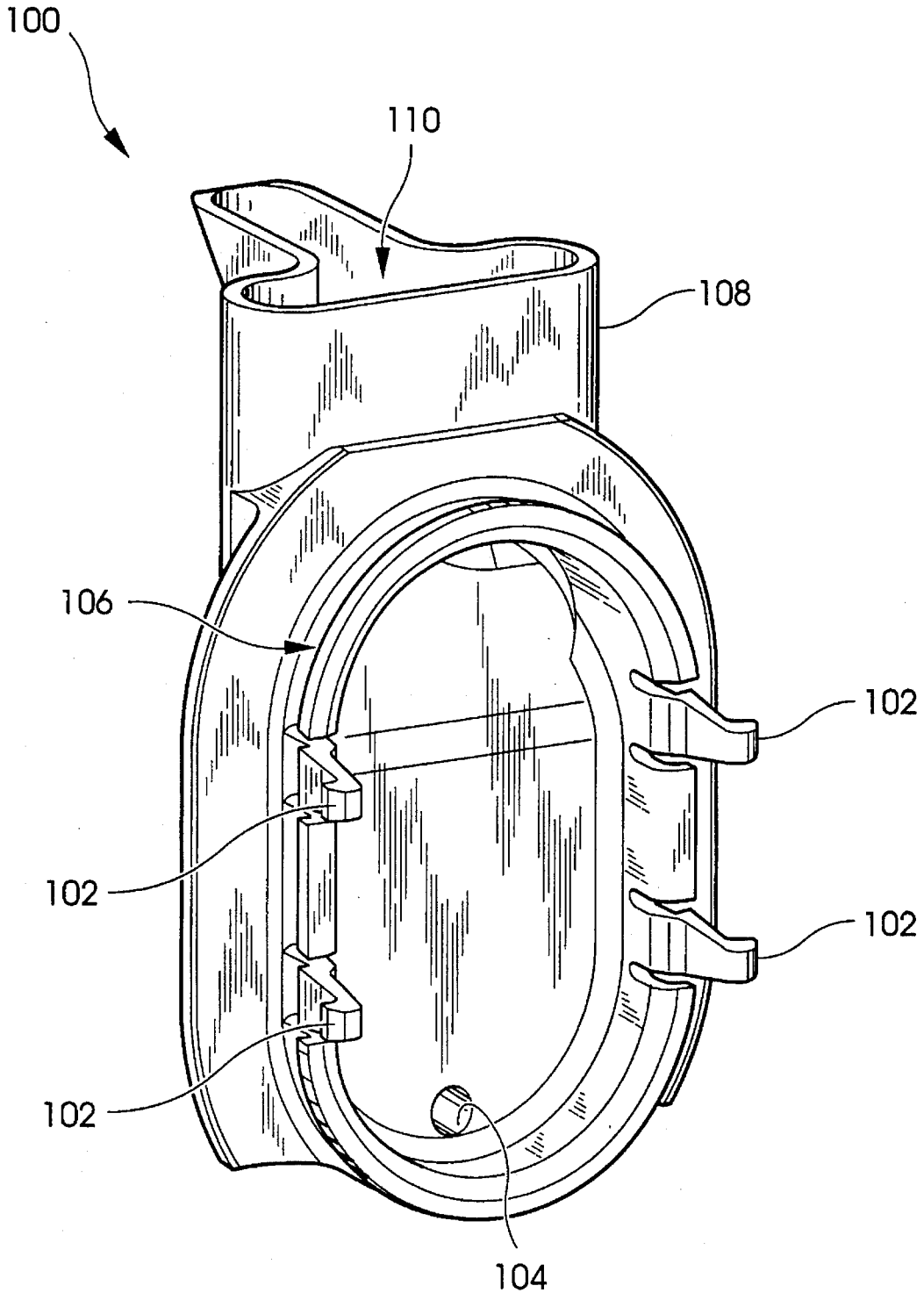
FIG. 14 is a perspective view of a seventh embodiment of the present invention.

Referring now to FIG. 12, the insert 84 is shown from the opposite side. The oil flowing over the edge 90 exits the chute 94 through the drainback hole 30 and is drained back to the oil pan. The insert 84 includes a circumferential groove 96 into which is mounted an appropriate seal not shown) in order to seal the insert 84 against the wall in which the drainback hole 30 is formed. Referring to FIG. 13, the inserts 84 are illustrated installed into the prior art camshaft compartment 10. It can be seen that the oil will rise to the level 98 during engine operation. The position of the level 98 is determined by the height of the stacks 92 of the inserts 84. After engine shut down, the oil will drainback to the oil pan through the small drainback holes 88 formed in the inserts 84. Referring now to FIG. 14, there is illustrated a seventh embodiment of the present invention, indicated generally at 100. The insert 100 is similar to the insert 84 and provides the same function within the camshaft compartment 10. However, the insert 100 has several features which are different from the insert 84. Like the insert 84, the insert 100 mounts through the drainback hole 30 via integral tangs 102 and thereby blocks the drainback hole 30 from draining oil. The insert 100 also includes a small drain hole 104 for draining the oil from the camshaft compartment 10 after engine shut down. Unlike the insert 84, the insert 100 includes a groove 106 which extends perpendicular to the plane of the drainback hole 30. A seal (not shown) placed within the groove 106 will therefore engage against the transverse surface of the drainback hole 30. Such an engagement of the seal is required in situations where the wall in which drainback hole 30 is formed is not planar and therefore does not lend itself to engagement with a sealing surface. The insert 100 further includes a stack 108 which includes a T-shaped opening 110. The T-shaped opening 110 facilitates skimming of the oil when the engine is operated on a non-level surface, or if the engine is installed within the vehicle at a large angle from the horizontal.

Figure 15:
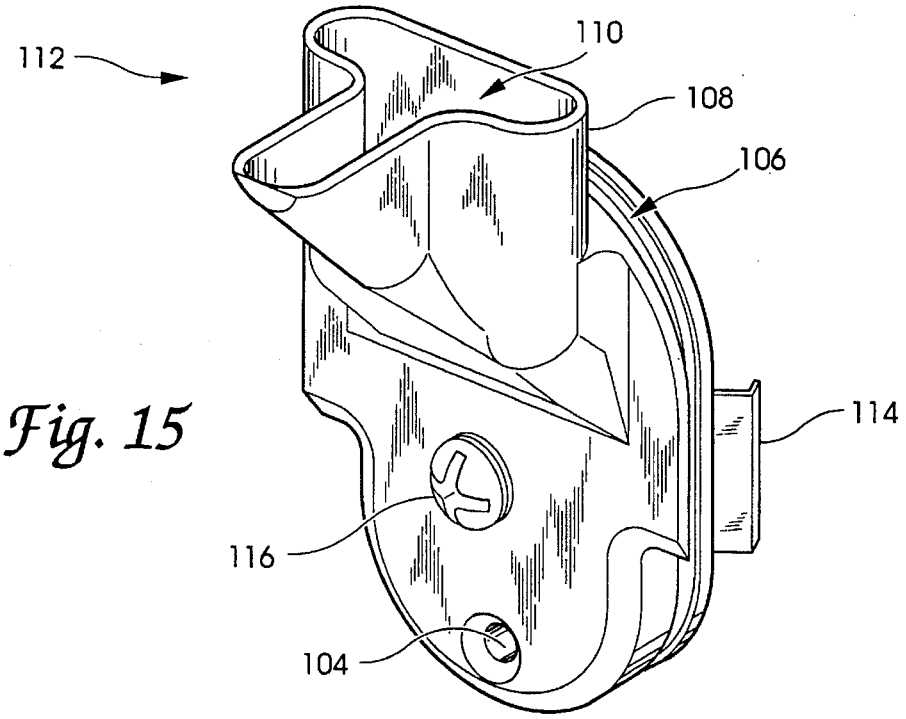
FIG. 15 is a front perspective view of an eighth embodiment of the present invention.
Figure 16:
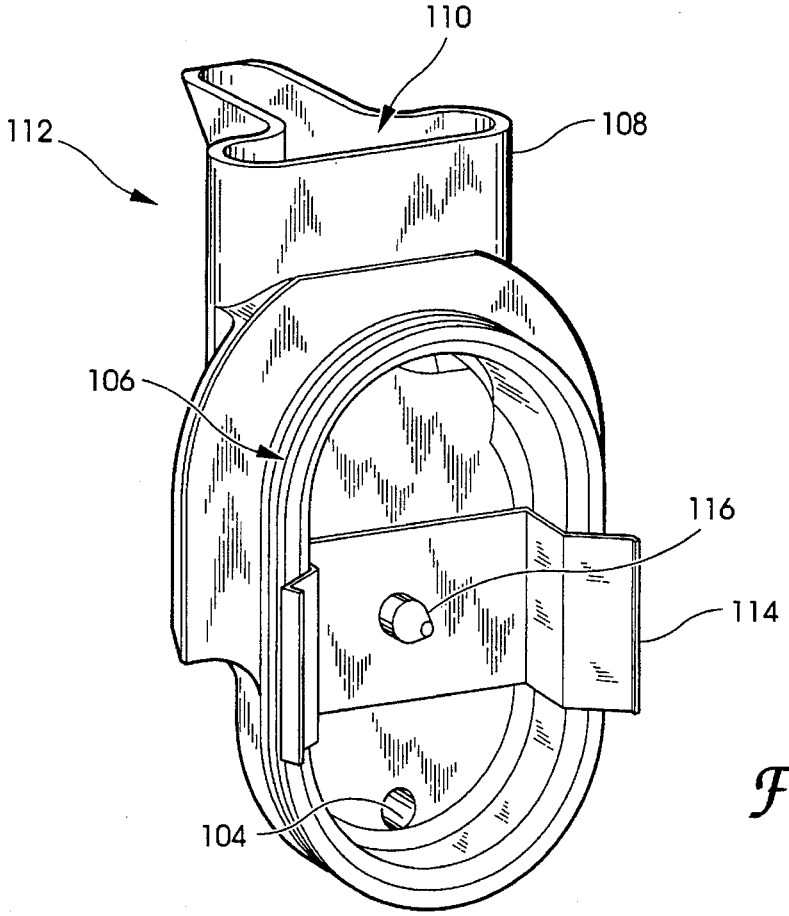
FIG. 16 is a rear perspective view of the eighth embodiment of the present invention.

Referring now to FIGS. 15–16, an eighth embodiment of the present invention is illustrated and indicated generally at 112. The insert 112 is substantially similar to the insert 100 of FIG. 14 and the particular shape of the stack 108 and T-shaped opening 110 are better illustrated in FIG. 15. However the integral tangs 102 of the insert 100 have been replaced in the insert 112 with a one piece metal clip 114 which is mounted to the insert 112 via a screw 116. The clip 114 is preferably formed from a resilient metal such as spring steel.

Figure 17:
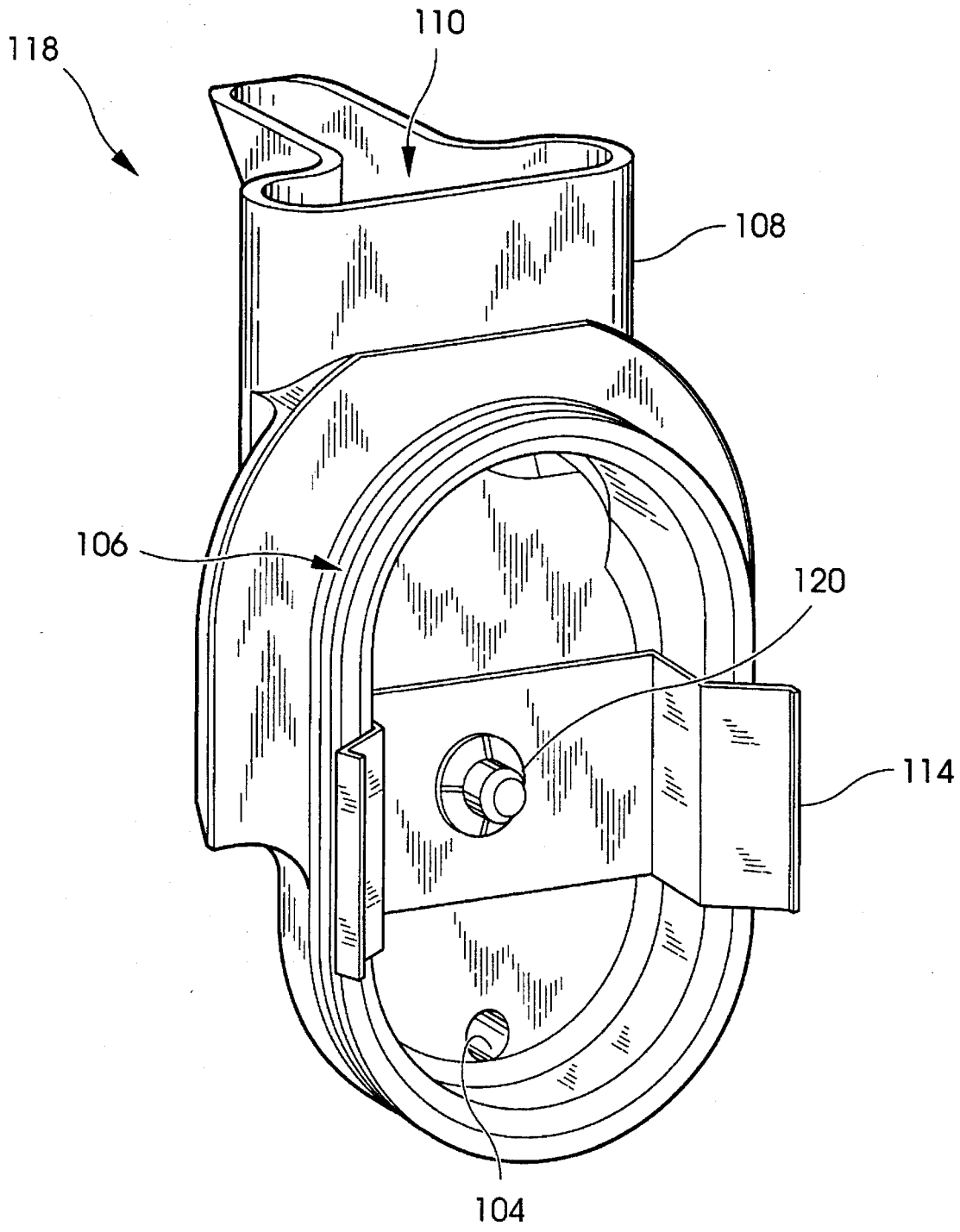
FIG. 17 is a perspective view of a ninth embodiment of the present invention.

Referring now to FIG. 17, there is illustrated a ninth embodiment of the present invention, indicated generally at 118. The insert 118 is substantially similar to the insert 112, with the exception that the spring clip 114 is mounted to the insert 118 via a molded post 120. The molded post 120 is formed from the same material as the remainder of the insert 118, which is preferably plastic, and is designed to have is interference fit with the mounting hole of the spring clip 114.

Figure 18:
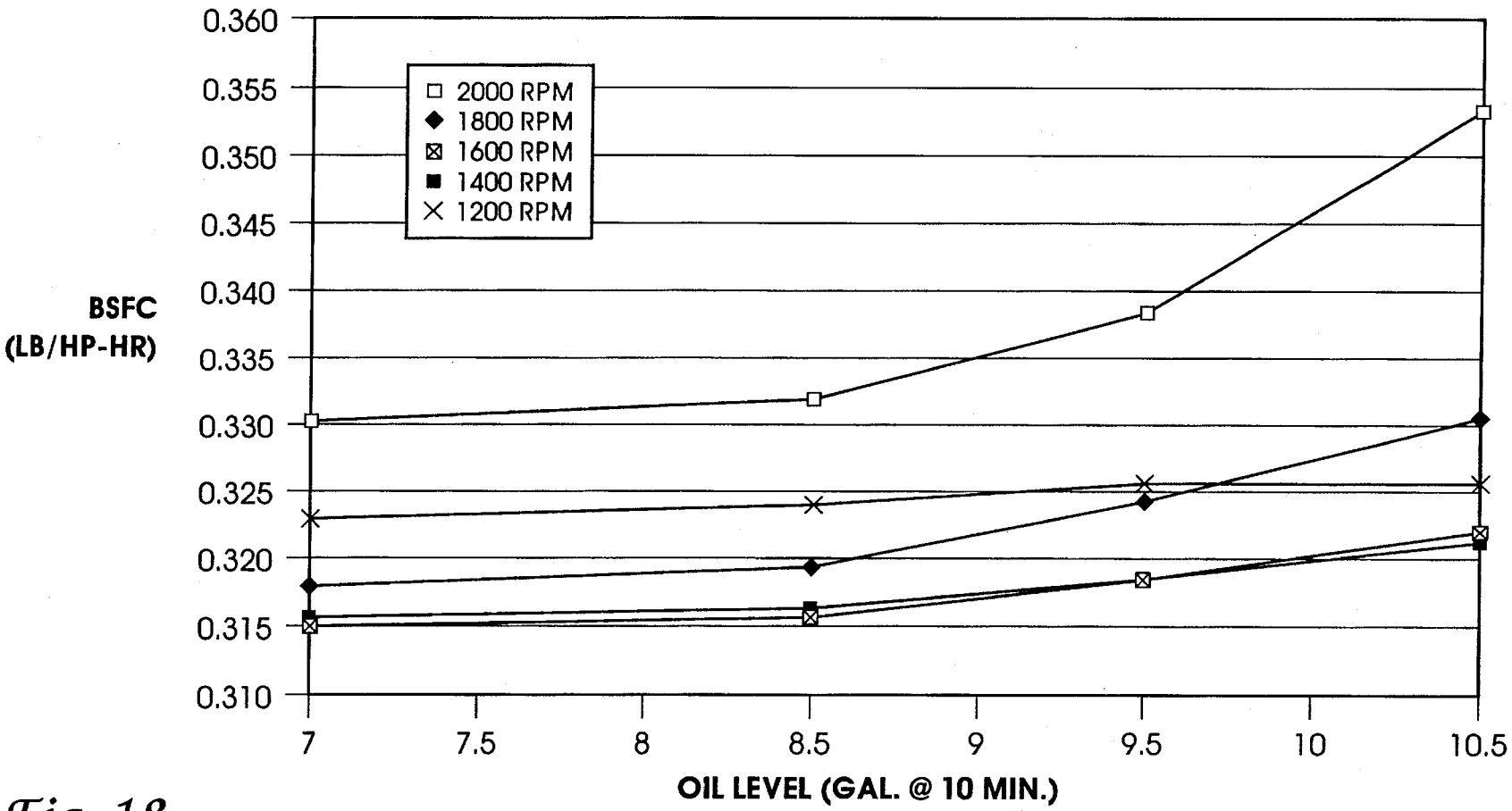
FIG. 18 is a graph of brake specific fuel consumption versus engine oil level.

Referring now to FIG. 18, there is illustrated experimental data which relates brake specific fuel consumption in an internal combustion engine with the level of oil in the oil pan, at various engine speeds. In order to obtain the data of FIG. 18, the oil level in the oil pan of the engine was measured ten minutes after engine shut down. It will be readily appreciated by those skilled in the art that the oil level has a marked influence on the amount of fuel consumption in an internal combustion engine. Particularly, at high engine speeds the parasitic loss from the interaction between the crankshaft and the engine oil in the oil pan is quite large. It will therefore be appreciated that use of the engine oil capacitor concept of the present invention will allow a significant quantity of oil (1–2 gallons) to be removed from the oil pan during engine operation and temporarily stored in the camshaft compartment. The removal of this quantity of oil from the oil pan during engine operation allows for an increased volume of oil to be used in the engine, thereby extending drain intervals, without the need to increase the size of the oil pan and without reducing fuel economy. Thus, for any particular existing engine design, an amount of oil equal to the amount of oil which can be stored in the camshaft compartment can be added to the oil pan without increasing the interaction between the crankshaft and the oil in the oil pan.

It will be appreciated by those skilled ill the art that, although the above embodiments of the present invention provide for oil storage in the camshaft compartment, such oil storage may be affected in any non-sump engine compartment. The principles of the present invention, as described hereinabove, may be applied to affect oil storage in any engine compartment by one having ordinary skill in the art following the teachings herein.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An engine compartment having an oil capacitor function, the engine compartment comprising:

at least one primary oil drainback hole formed in the engine compartment and operative to channel oil flowing therethrough to an oil pan, wherein the primary oil drainback hole is positioned such that the oil must accumulate to a first level before the oil can flow through the primary oil drainback hole; and at least one secondary oil drainback hole formed in the engine compartment and operative to channel oil flowing therethrough into the oil pan, wherein the secondary oil drainback hole is positioned such that the oil must be at a second level before the oil can flow through the secondary oil drainback hole;

wherein the first level is higher than the second level such that a quantity of oil is stored in the engine compartment when the oil is at the first level; and wherein a first flow capacity of the primary oil drainback hole is greater than a second flow capacity of the secondary oil drainback hole; and wherein the oil is supplied to the engine compartment at a flow rate which is less than the first flow capacity and greater than the second flow capacity.

2. The engine compartment of claim 1, wherein the engine compartment comprises a camshaft compartment.

3. The engine compartment of claim 2, further comprising:

a plurality of walls each having a camshaft journal formed therein;

wherein the first level is established by an upper surface of at least one of the plurality of walls.

4. The engine compartment of claim 1, wherein the first level is established by a lower surface of the primary oil drainback hole.

5. The engine compartment of claim 1, wherein the second level is substantially at a bottom of the engine compartment, such that substantially no oil is stored in the engine compartment when the oil is at the second level.

6. An oil capacitor insert adapted to be placed within an engine compartment, the insert comprising:

a plurality of walls forming an oil retention cavity;

a weir formed in at least one of the walls and operative to drain oil from within the oil retention cavity, wherein the weir is positioned such that the oil must accumulate to a first level before the oil can flow over the weir; and a drainback hole formed in at least one of the walls and operative to drain oil from within the oil retention cavity, wherein the drainback hole is positioned such that the oil must be at a second level before the oil can flow through the drainback hole;

wherein the first level is higher than the second level such that a first quantity of oil is stored in the oil retention cavity when the oil is at the first level; and wherein a first flow capacity of the weir is greater than a second flow capacity of the drainback hole; and wherein the oil is supplied to the insert at a flow rate which is less than the first flow capacity and greater than the second flow capacity.

7. The oil capacitor insert of claim 6, wherein the engine compartment comprises a camshaft compartment.

8. The oil capacitor insert of claim 7, wherein two of said walls include openings which allow passage of a camshaft through the insert.

9. The oil capacitor insert of claim 8, further comprising:

a wetting tray positioned in the oil retention cavity and operative to store a second quantity of oil, the second quantity of oil being isolated from the weir and the drainback hole;

wherein the camshaft is in contact with the second quantity of oil.

10. The oil capacitor insert of claim 9, wherein the wetting tray may be moved away from the camshaft during installation and removal of the camshaft.

11. The oil capacitor insert of claim 10, wherein the wetting tray is hingedly attached to the insert.

12. The oil capacitor insert of claim 11, wherein the wetting tray includes first teeth and the insert includes second teeth, wherein the first and second teeth interengage when the wetting tray is in a free running position.

13. The oil capacitor insert of claim 6, wherein the second level is substantially at a bottom of the oil retention cavity, such that substantially no oil is stored in the oil retention cavity when the oil is at the second level.

14. An internal combustion engine including at least one oil capacitor insert adapted to engage an oil drainback hole formed in a wall of an engine compartment of said engine, each insert comprising:

a body member having an opening therein;

at least one retention member coupled to the body member; wherein the retention member is operative to engage the wall such that the drainback hole is filled in by the body member;

a stack coupled to the body member, the stack having a stack opening at a top surface thereof and a hollow interior channel coupling the stack opening to the body member opening for fluid flow therebetween;

wherein the stack opening is at a level above a bottom of the drainback hole, such that oil supplied to the engine compartment accumulates therein until the oil reaches the level of the stack opening and flows through the interior channel and through the drainback hole.

15. The engine of claim 14, wherein the engine compartment comprises a camshaft compartment.

16. The engine of claim 14, further comprising:

a secondary oil drainback hole formed in the body member at a second level;

wherein the stack opening level is higher than the second level such that a quantity of oil is stored in the engine compartment when the oil is at the stack opening level; and wherein a first flow capacity of the stack opening is greater than a second flow capacity of the secondary oil drainback hole; and wherein the oil is supplied to the engine compartment at a flow rate which is less than a combined first flow capacity of all said inserts and greater than a combined second flow capacity of all said inserts.

17. The engine of claim 16, wherein the second level is substantially at a bottom of the body member, such that substantially no oil is stored in the engine compartment when the oil is at the second level.

18. The engine of claim 14, wherein the at least one retention member comprises at least one tang integrally formed with the body member.

19. The engine of claim 14, wherein the at least one retention member comprises a spring steel clip.

20. The engine of claim 14, wherein the stack opening is substantially rectangular.

21. The engine of claim 14, wherein the stack opening is substantially T-shaped.

22. The engine of claim 14, further comprising:

a groove formed in the body member; and a seal placed in the groove, wherein the seal engages the wall such that substantially no oil may flow past the seal.

* * * * *

UNITED STATES PATENT AND TRADEMARK OFFICE

CERTIFICATE OF CORRECTION

PATENT NO. : 5,479,886

DATED : January 2, 1996

INVENTOR(S) : Jay F. Leonard, Richard J. Gustafson, Mark B. Hinderleider

It is certified that error appears in the above-identified patent and that said Letters Patent is hereby corrected as shown below:

In column 1, line 32, please insert a comma after "process".
In column 1, line 33, please delete the comma after "compartment".
In column 1, line 53, please change "tilled" to —filled—.
In column 1, line 66, please delete the comma after "can't".
In column 1, line 67, please change "therebefore" to —therefor—.
In column 2, line 9, please change "the" to —fuel—.
In column 2, line 30, please change ":" to —;—.
In column 6, line 38, please change "70)" to --70,--.
In column 6, line 44, please change "or", second occurrence, to —of—.
In column 7, line 11, please change "throned" to —formed—.
In column 7, line 16, please delete the comma after "camshaft".
In column 7, line 25, please insert —(— before "not".
In column 7, line 34, "Referring" should begin a new paragraph.
In column 7, line 36, please insert a comma after "84".
In column 7, line 51, please insert a comma after "planar".
In column 7, line 61, please insert a comma after "14".
In column 7, line 63, please insert a comma after "However".
In column 8, line 7, please change "is", third occurrence, to —an—.
In column 8, line 34, please change "ill" to —in—.

Signed and Sealed this

Third Day of December, 1996

Bruce Lehman

*Attest:*

BRUCE LEHMAN

*Attesting Officer*

*Commissioner of Patents and Trademarks*